US011211734B2

(12) United States Patent
Hung

(10) Patent No.: US 11,211,734 B2
(45) Date of Patent: Dec. 28, 2021

(54) ELECTRICAL CONNECTOR

(71) Applicant: Dongguan Luxshare Technologies Co., Ltd, Dongguan (CN)

(72) Inventor: Yung-Chih Hung, Taipei (TW)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/038,466

(22) Filed: Sep. 30, 2020

(65) Prior Publication Data

US 2021/0313729 A1 Oct. 7, 2021

(30) Foreign Application Priority Data

Apr. 7, 2020 (TW) ..... 109111668

(51) Int. Cl.
*H01R 13/436* (2006.01)
*H01R 13/18* (2006.01)
*H01R 13/58* (2006.01)
*H01R 13/627* (2006.01)

(52) U.S. Cl.
CPC ..... *H01R 13/4367* (2013.01); *H01R 13/18* (2013.01); *H01R 13/5829* (2013.01); *H01R 13/6276* (2013.01)

(58) Field of Classification Search
CPC ..... H01R 13/18
See application file for complete search history.

(56) References Cited

U.S. PATENT DOCUMENTS 8,840,415 B2 9/2014 Orris et al.
9,054,456 B2 6/2015 Orris et al.
9,070,990 B2 6/2015 Flickinger et al.
9,450,331 B1 * 9/2016 Luo ..... H01R 13/18
(Continued)

FOREIGN PATENT DOCUMENTS

CN 1685572 A 10/2005
CN 203942061 U 11/2014
(Continued)

OTHER PUBLICATIONS

"Power Connectors and Cable Assemblies for Open Compute Project (OCP)", TE Connectivity, Sep. 2017, total 4 pages.
(Continued)

*Primary Examiner* — Ross N Gushi
(74) *Attorney, Agent, or Firm* — Birch, Stewart, Kolasch & Birch, LLP

(57) ABSTRACT

An electrical connector comprises an insulating body, a pair of first terminal members, a pair of second terminal members, and a fastening part. The insulating body comprises a mating groove. The pair of first terminal members is disposed in the mating groove. Each of the first terminal members comprises a plurality of first elastic contacting parts. The pair of second terminal members is disposed in the mating groove. The pair of first terminal members is disposed between the pair of second terminal members. Each of the second terminal members comprises a plurality of second elastic contacting parts. The second elastic contacting part abuts against the first elastic contacting portion correspondingly. The fastening part fastens the pair of first terminal members and the pair of second terminal members.

13 Claims, 6 Drawing Sheets

(56) References Cited

U.S. PATENT DOCUMENTS

| | | | | |
|---|---|---|---|---|
| 9,537,253 | B2 | 1/2017 | Zhao | |
| 9,680,236 | B2 * | 6/2017 | Ngo | H01R 13/113 |
| 10,050,395 | B2 * | 8/2018 | Ngo | H01R 25/162 |
| 10,374,334 | B2 * | 8/2019 | Li | H01R 4/184 |
| 10,581,196 | B2 * | 3/2020 | Liu | H01R 25/162 |
| 2017/0054243 | A1 | 2/2017 | Nichols et al. | |

FOREIGN PATENT DOCUMENTS

| | | | |
|---|---|---|---|
| CN | 105098395 | A | 11/2015 |
| CN | 105830284 | A | 8/2016 |
| CN | 206640005 | U | 11/2017 |
| CN | 208256918 | U | 12/2018 |
| CN | 109510015 | A | 3/2019 |
| CN | 109524822 | A | 3/2019 |
| CN | 110277679 | A | 9/2019 |
| CN | 111384614 | A | 7/2020 |
| EP | 2017922 | A2 | 1/2009 |
| GB | 2 024 535 | A | 1/1980 |
| TW | 201611413 | A | 3/2016 |

OTHER PUBLICATIONS

"Side Exit CCJ (Crown Clip Junior) Cable Assembly System", TE Connectivity, Nov. 22, 2017, Rev 1, total 5 pages.

* cited by examiner

ELECTRICAL CONNECTOR

CROSS REFERENCE TO RELATED APPLICATION

This application claims the priority benefit of Taiwanese Patent Application Serial Number TW109111668, filed on Apr. 7, 2020, the full disclosure of which is incorporated herein by reference.

BACKGROUND

Technical Field

The present disclosure relates to the technical field of electrical connector, particularly to an electrical connector having a configuration for increasing terminal retention.

Related Art

In general, electrical connectors are used to connect two electronic devices or electronic components to transmit signals or power, and the electrical connectors are also used to electrically connect to the BUS conductive plates. The BUS conductive plate is provided with copper or aluminum bars for electrical connection. The electrical connector for the BUS conductive plate comprises two rows of terminals oppositely disposed. When the electrical connector is plugged into the BUS conductive plate, the two rows of terminals would be biased on the copper bar of the BUS conductive plate to achieve functions of contacting, plugging and unplugging. The conventional electrical connectors of the BUS conductive plate are provided with retaining members on the outside of the two rows of terminals oppositely disposed. The retaining members could increase the retaining force of the terminal bias on the BUS conductive board. However, most of the conventional retaining members are provided with metal plates to cover all terminals, which cannot provide retaining force according to the degree of individual terminal deformation, resulting in the problem of an uneven retaining force on the BUS conductive board. In addition, the conventional upper and lower retaining members are a part of a bent component processed by bending a whole piece of metal plate to form a C-shaped component, which has a problem of difficulties in assembly.

SUMMARY

The embodiments of the present disclosure provide an electrical connector tended to solve the problem of uneven retaining force provided by the retaining members of the electrical connector of the BUS conductive plate to the terminals and the problem of assembling difficulties.

The present disclosure provides an electrical connector, comprising an insulating body, a pair of first terminal members, a pair of second terminal members, and a fastening part. The insulating body comprises a mating groove. The pair of first terminal members is disposed in the mating groove. Each of the first terminal members comprises a plurality of first elastic contacting parts. The pair of second terminal members is disposed in the mating groove. The pair of first terminal members is disposed between the pair of second terminal members. Each of the second terminal members comprises a plurality of second elastic contacting parts abutting against the plurality of first elastic contacting parts correspondingly. The fastening part fastens the pair of first terminal members and the pair of second terminal members.

In the embodiments of the present disclosure, the first terminal members clamp the circuit board. By disposing the first terminal members between the pair of second terminal members, the second elastic contacting parts of the second terminal members abut against the first elastic contacting parts of the first terminal members correspondingly. The second terminal members could apply a retaining force to the first terminal members to retain the first terminal members in contact with the circuit board. Each of the first elastic contacting parts is provided with a retaining force by individual second elastic contacting part. Thus, an average retaining force is provided to each of the first elastic contacting parts of each of the first terminal members. In addition, in the present disclosure, the pair of first terminal members is separable and the pair of second terminal members is also separable to facilitate the assembly and solves the problem of assembling difficulties in the prior art.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
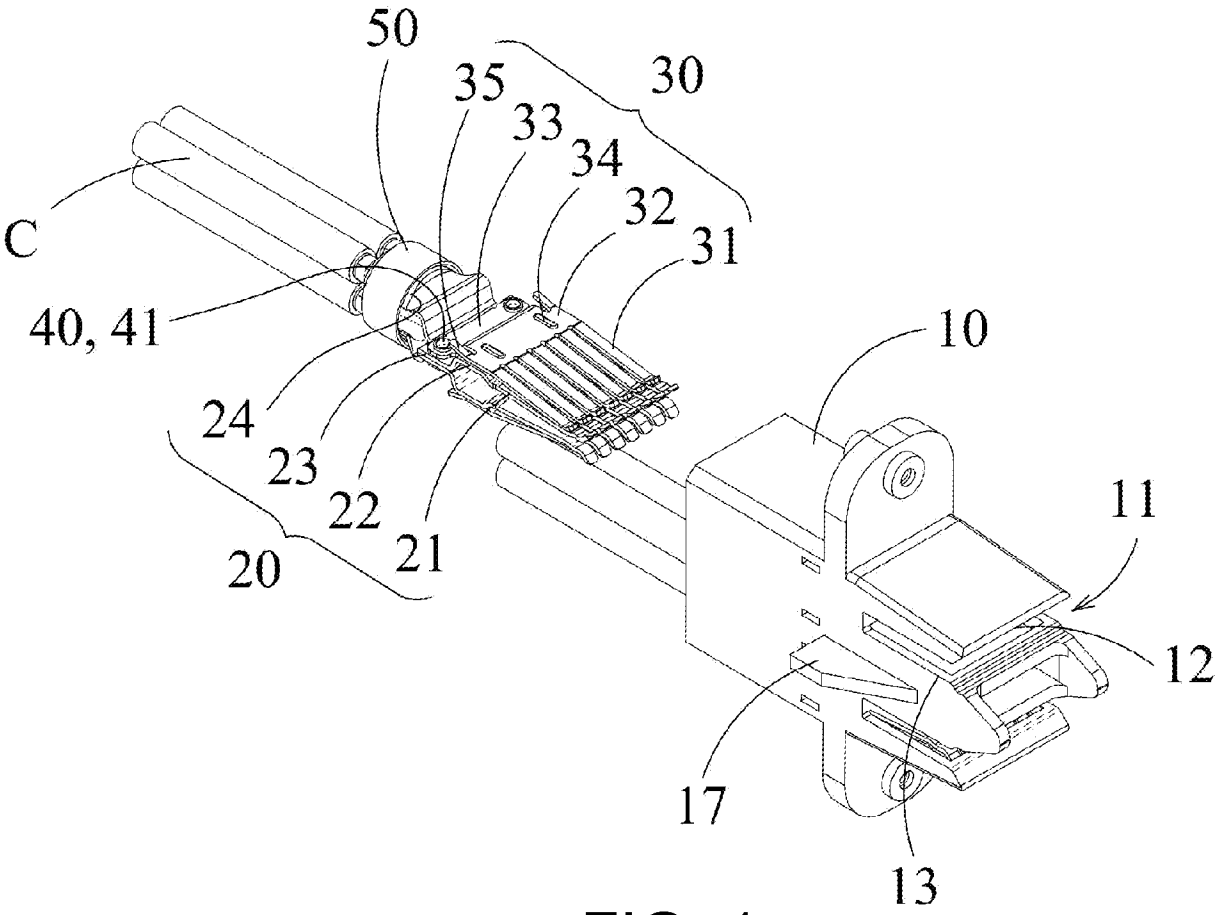
FIG. 1 is a partially exploded view of an electrical connector of the first embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the disclosure.

Figure 2:
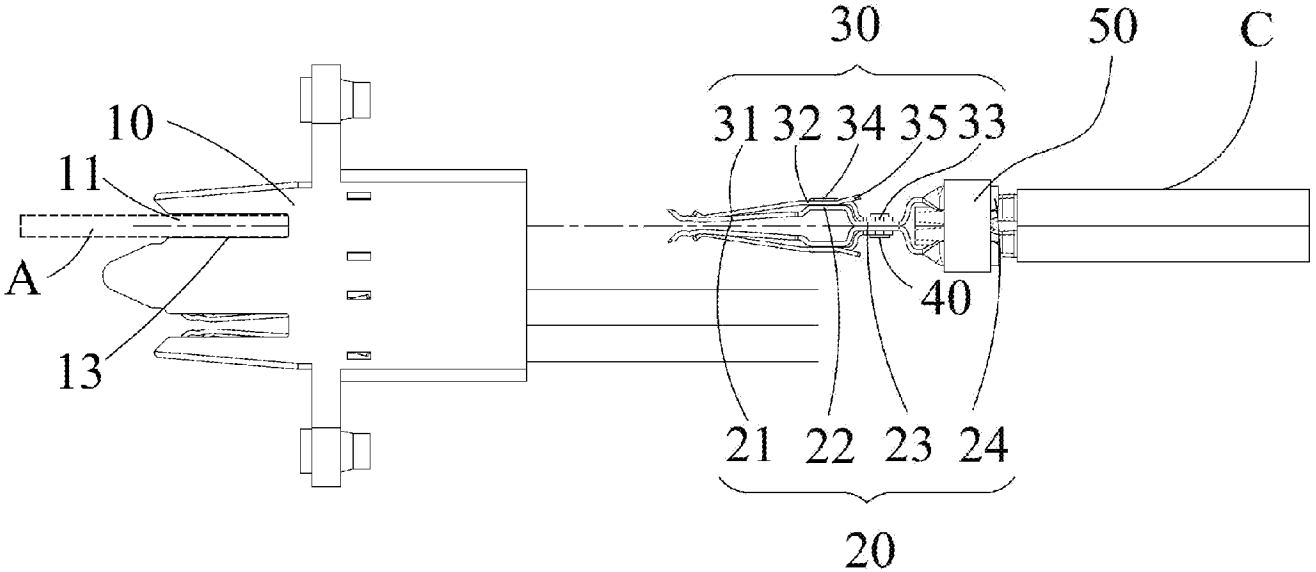
FIG. 2 is a side view of the electrical connector of FIG. 1.
Figure 3:
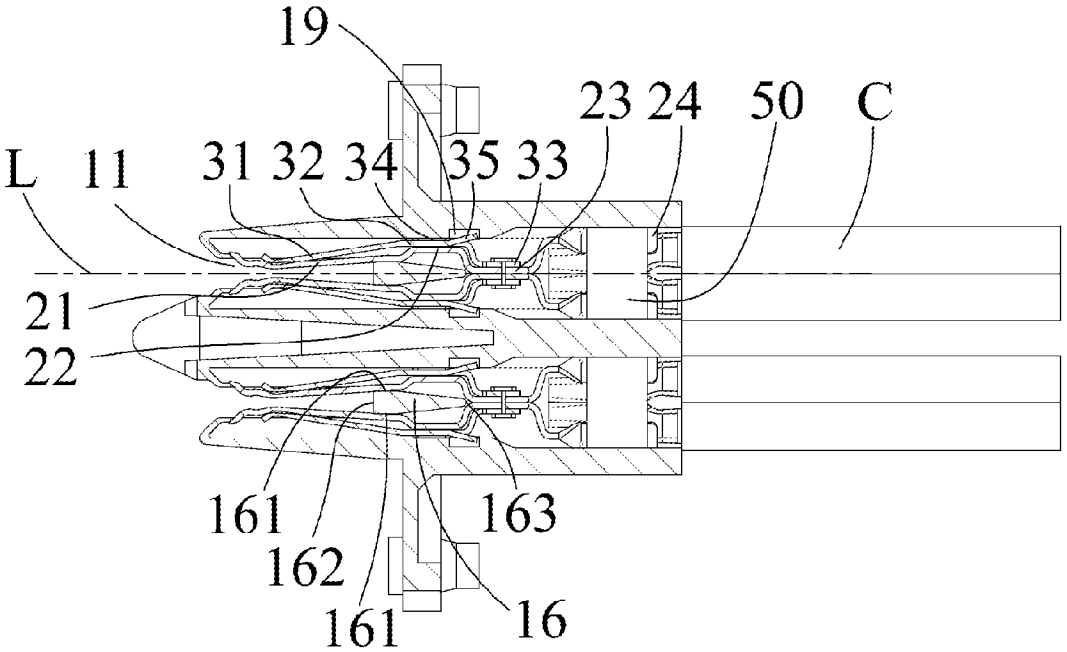
FIG. 3 is a cross-sectional view of the electrical connector of the first embodiment of the present disclosure.
Figure 4:
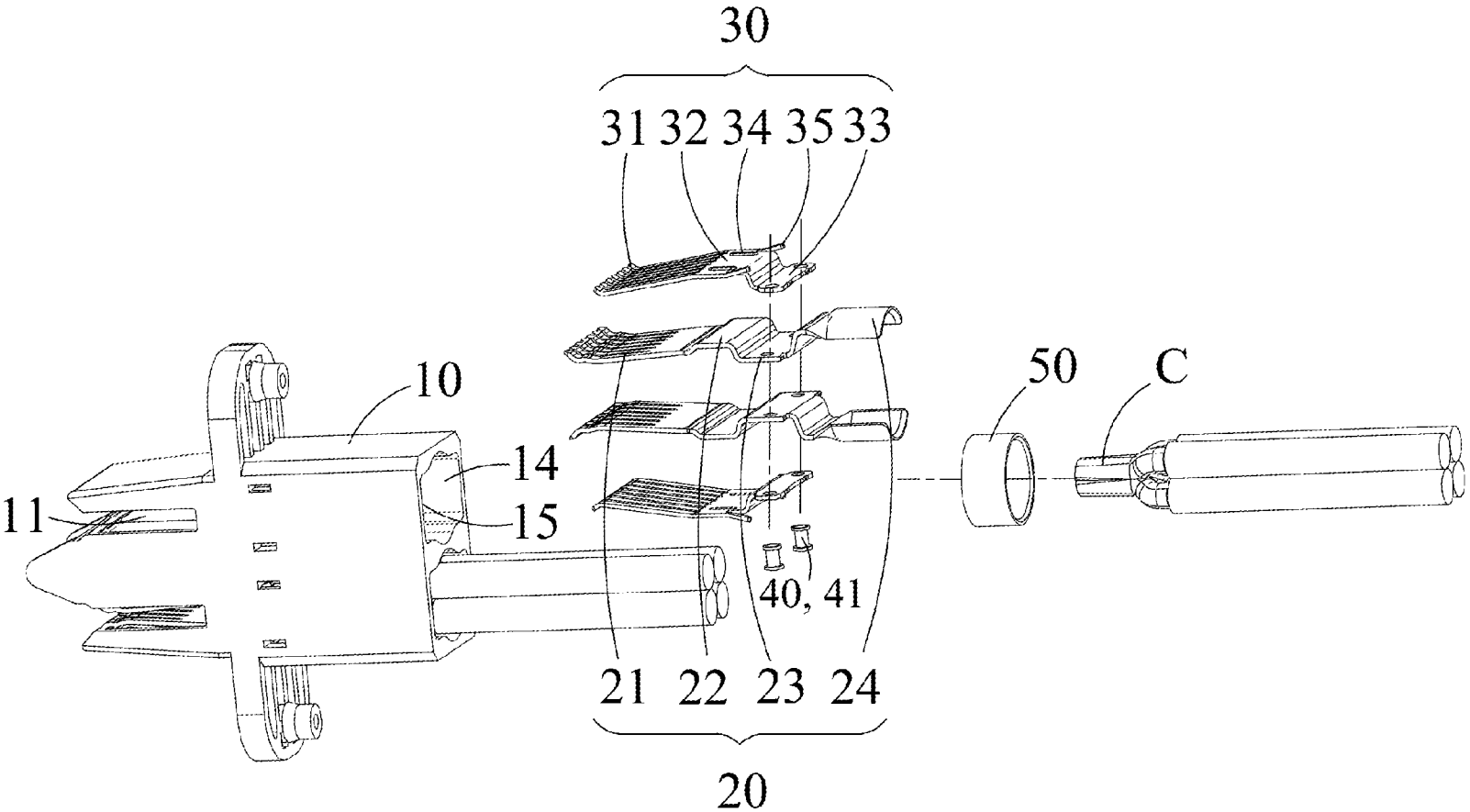
FIG. 4 is an exploded perspective view of the electrical connector of the first embodiment of the present disclosure.

FIG. 1 is a partially exploded view of an electrical connector of the first embodiment of the present disclosure. FIG. 2 is a side view of the electrical connector of FIG. 1. FIG. 3 is a cross-sectional view of the electrical connector of the first embodiment of the present disclosure. FIG. 4 is an exploded perspective view of the electrical connector of the first embodiment of the present disclosure. As shown in the figures, the electrical connector of the present disclosure comprises an insulating body 10, a pair of first terminal members 20, a pair of second terminal members 30, and a fastening part 40. The insulating body 10 has a mating groove 11. The pair of first terminal members 20 is disposed in the mating groove 11. Each of the first terminal members 20 comprises a plurality of first elastic contacting parts 21. The pair of second terminal members 30 is disposed in the mating groove 11. The pair of first terminal members 20 is disposed between the pair of second terminal members 30. Each of the second terminals members 30 comprises a plurality of second elastic contacting parts 31 respectively abut against the plurality of first elastic contacting parts 21. The fastening part 40 fastens the pair of first terminal members 20 and the pair of second terminal members 30.

As shown on FIG. 1, FIG. 2, and FIG. 3, the insulating body 10 may be produced by plastic injection molding. The insulating body 10 has a mating groove 11, in front of which is a plugging port 12. The two opposite sidewalls of the mating groove 11 are respectively provided with an opening 13. The opening 13 communicates with the plugging port 12 so that the circuit board A can be inserted into the mating groove 11 through the plugging port 12 and the opening 13 (as shown in FIG. 2). The width of the opening 13 is slightly greater than the thickness of the circuit board A to achieve the purpose of positioning. The circuit board A can abut against an end of the opening 13 to stop the circuit board A. The insulating body 10 further has a cable accommodating groove 14 (as shown in FIG. 4) communicating with the mating groove 11 so that the first terminal member 20 which is secured to the second terminal member 30 can extend into the cable accommodating groove 14 and can be installed in the insulating body 10. The insulating body 10 further comprises a cable extension opening 15 to accommodate the cable C connected to the first terminal member 20. A stopping block 16 is provided inside the mating groove 11. The stopping block 16 is disposed between the mating groove 11 and the cable accommodating groove 14, and comprises two opposite sidewalls 161 and a first end 162 opposite to a second end 163. The two sidewalls 161 are inclined to facilitate the insertion of the terminal into the mating groove 11. The first end 162 faces the mating groove 11, and the second end 163 faces the cable accommodating groove 14 and is away from the mating groove 11. In addition, the insulating body 10 further has an anti-misconnecting part 17, which is asymmetrically disposed compare with a shape of the mating groove 11. In this embodiment, the anti-misconnecting part 17 comprises a bump disposed on an outer wall of the insulating body 10 and is only disposed on one outer wall of the insulating body 10. When the electrical connector of the present disclosure is mated with the corresponding electrical connector on the circuit board, the electrical connector of the present disclosure can be prevented from being misconnected by correspondingly inserting a bump into a corresponding groove of an electrical connector on a circuit board.

As shown in FIG. 3 and FIG. 4, the first terminal member 20 and the second terminal member 30 can be produced by stamping. The first terminal member 20 and the second terminal member 30 are inserted into the mating groove 11 of the insulating body 10. The second terminal member 30 is closer than the first terminal member 20 to the groove wall of the mating groove 11. The pair of first terminal members 20 is separable, and the pair of second terminal members 30 is also separable. In this way, it can be assembled one by one during assembly, and the assembly process would be relatively simple and easy.

Each of the first elastic contacting parts 21 is an elastic contacting arm, and each of the second elastic contacting parts 31 is also an elastic contacting arm. In this embodiment, the pair of first terminal members 20 is disposed symmetrically relative to the centerline L of the mating groove 11. The centerline L of the mating groove 11 is defined as a line extending in the mating direction of the mating groove 11 and having an equal distance from the upper and lower wall surfaces of the mating groove 11. Similarly, the pair of second terminal members 30 is disposed symmetrically relative to the centerline L of the mating groove 11. Each of the second elastic contacting parts 31 abuts against the corresponding first elastic contacting parts 21. When the circuit board is inserted into the mating groove 11, the first elastic contacting part 21 would be pushed by the circuit board causing an elastic deformation. By an elastic force generated by the elastic deformation, the first elastic contacting part 21 would press against the conductive metal bar (copper bar or aluminum bar, etc.) of the circuit board, thereby achieving an electrical connection with the circuit board. The second elastic contacting part 31 is also elastically deformed due to the insertion of the circuit board which presses against the first elastic contacting part 21, thereby providing a retaining force to the first elastic contacting part 21. Each of the first elastic contacting part 21 is provided with a retaining force by an individual second elastic contacting part 31, which averagely provides retaining force to each of the first elastic contacting parts 21 of each of the first terminal members 20. In addition, in the present embodiment, the first elastic contacting parts 21 of the two first terminal members 20 respectively abut against the two side walls 161 of the stopping block 16 of the insulating body 10.

Each of the first terminal members 20 further comprises a first abutting part 22. The plurality of first elastic contacting parts 21 is connected to the first abutting part 22. Each of the second terminal members 30 comprises a second abutting part 32. The plurality of second elastic contacting parts 31 is connected to the second abutting part 32. In this embodiment, the first abutting part 22 is bent-sheet-shaped. The first elastic contacting part 21 is connected to one side of the first contacting part 22 and extends from the side toward the plugging port 12 of the mating groove 11. Each of the first elastic contacting parts 21 gradually approaches the centerline L of the mating groove 11 from the side of the first abutting part 22 and becomes inclined. The first abutting parts 22 of the two first terminal members 20 are oppositely disposed. As described above, the two first terminal members 20 are disposed symmetrically relative to the centerline L, and the stopping block 16 is sandwiched between the two first contacting parts 22. Thus, when the circuit board is inserted into the mating groove 11, the first elastic contacting part 21 is pressed to be elastically deformed by the circuit board having a thickness. In addition, in the present embodiment, the second contacting part 32 abuts against the first contacting part 22. Therefore, in addition to the second elastic contacting part 31 pressing against the first elastic contacting part 21 to provide a retaining force, a retaining force generated by abutting against the first abutting part 22 by the second abutting part 32 can also be applied to another pressing point. So that the second terminal member 30 could integrally provide a greater retaining force for the first terminal member 20.

Each of the first terminal members 20 further comprises a first connecting part 23. The first connecting part 23 is connected to the first contacting part 22. Each of the second terminal members 30 further comprises a second connecting part 33. The second connecting part 33 is connected to the second contacting part 32. The first connecting part 23 has a shape of recessing toward the centerline L, similarly, the second connecting part 33 also has a shape of recessing toward the centerline L. Thereby, the first coupling parts 23 of the two first terminal members 20 could abut against each other. The second connecting part 33 of each of the second terminal members 30 abuts against the corresponding first connecting part 23 of the first terminal member 20. The fastening part 40 fastens the first coupling parts 23 and the second connecting parts 33. The fastening part 40 comprises at least one fastener 41. The first connecting part 23 and the second connecting part 33 are coupled by the at least one fastener. In this embodiment, the fastener 41 could be a rivet or a bolt penetrate through holes on the first connecting part 23 and the second connecting part 33, so that the two first terminal members 20 are fastened to each other, and the second terminal member 30 is fastened to the corresponding first terminal member 20. In other embodiments, the fastening part may also be a soldering part or an ultrasonic welding part to have the first connecting part 23 to be secured to the second connecting part 33. In addition, in this embodiment, when the first terminal member 20 and the second terminal member 30 are inserted into the insulating body 10, the two oppositely disposed first coupling parts 23 abut against the second end 163 of the stopping block 16. With the fastening part 40, the first terminal member 20 can be securely connected to the second terminal member 30.

Each of the first terminal member 20 further comprises a cable connecting part 24 connected to the first connecting part 23. In this embodiment, each cable connecting part 24 is a semicircular arc-shaped sheet. The cable connecting parts 24 of the two first terminal members 20 are oppositely disposed, forming a cylindrical accommodating space. A cable C is connected to the cable connecting parts 24 of the pair of first terminal members 20. That is, a cable C is inserted into the accommodating space formed by the two cable connecting parts 24, and the cable C is electrically connected to the first terminal member 20. The electrical connector of the present disclosure further comprises an annular securing member 50 which presses against the cable connecting parts 24. In this embodiment, the annular securing member 50 is cylindrical-shaped, which could be sleeved on the opposite cable connecting part 24, thereby to sandwich the cable C between the two cable connecting parts 24. When the first terminal member 20, the second terminal member 30 and the cable C are inserted into the insulating body 10, the cable connecting part 24, the annular securing member 50 and the cable C sandwiched between the two cable connecting parts 24 are accommodated in the cable accommodating groove 14 of the insulating body 10 and extend through the cable extension opening 15.

As shown in FIG. 1 and FIG. 4, each of the second terminal members 30 comprises at least one rib 34. The rib 34 is disposed on the second contacting part 32 and protrudes toward the insulating body 10. When the first terminal member 20 and the second terminal member 30, which are securely connected to each other, are inserted into the mating groove 11, the rib 34 of the second terminal member 30 abuts against a groove wall of the mating groove 11. As described above, the first elastic contacting part 21 of the first terminal member 20 abuts against the two sidewalls 161 of the stopping block 16 of the insulating body 10 respectively. Thereby, the position of the first terminal member 20 and the second terminal member 30 which are securely connected to each other could be limited in a direction perpendicular to the centerline L.

Each of the second terminal members 30 comprises at least one elastic tab 35. The elastic tab 35 is disposed on the second contacting part 32 and extends toward the insulating body 10 comprising at least one buckling groove 19. The elastic tab 35 is buckled to the buckling groove 19. The buckling groove 19 is provided on a groove wall of the mating groove 11. The buckling parts 35 are disposed on opposite sides of the second contacting part 32 and protrude away from the second contacting part 32. When the first terminal member 20 and the second terminal member 30, which are securely connected to each other, are inserted into the mating groove 11, the elastic tab 35 would be buckled to the buckling groove 19 of the insulating body 10. Thereby, the position of the first terminal member 20 and the second terminal member 30 which are securely connected to each other could be limited in a direction perpendicular to the centerline L.

Figure 5:
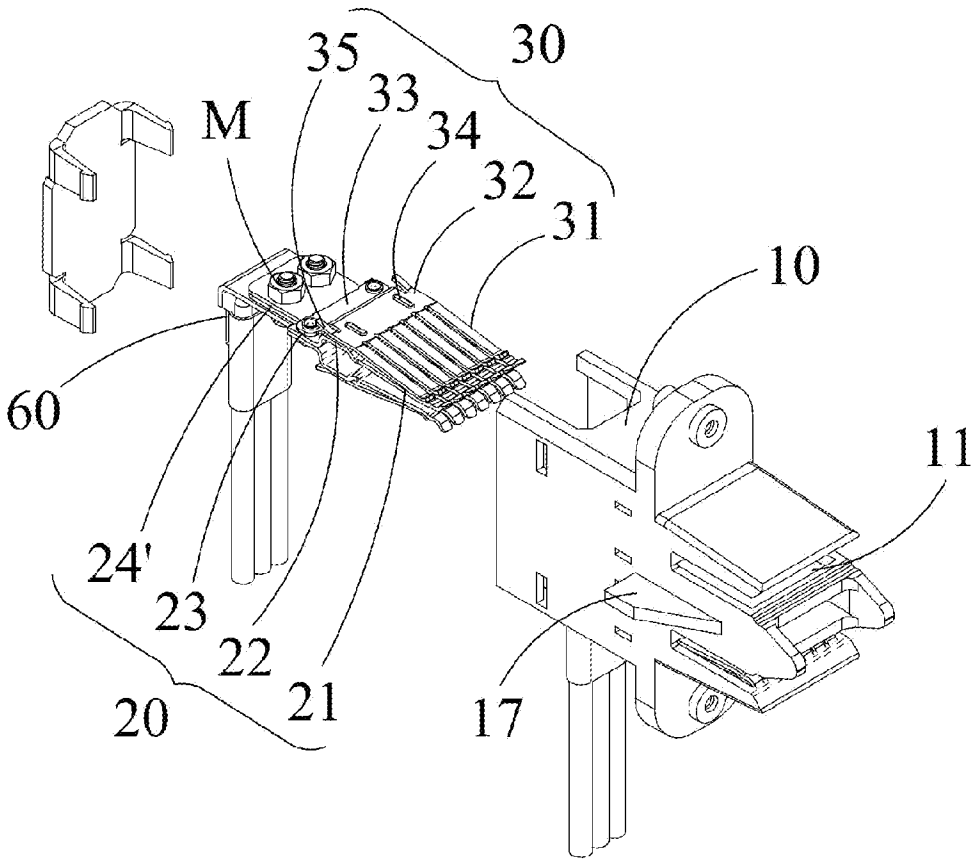
FIG. 5 is an exploded perspective view of an electrical connector of the second embodiment of the present disclosure.
Figure 6:
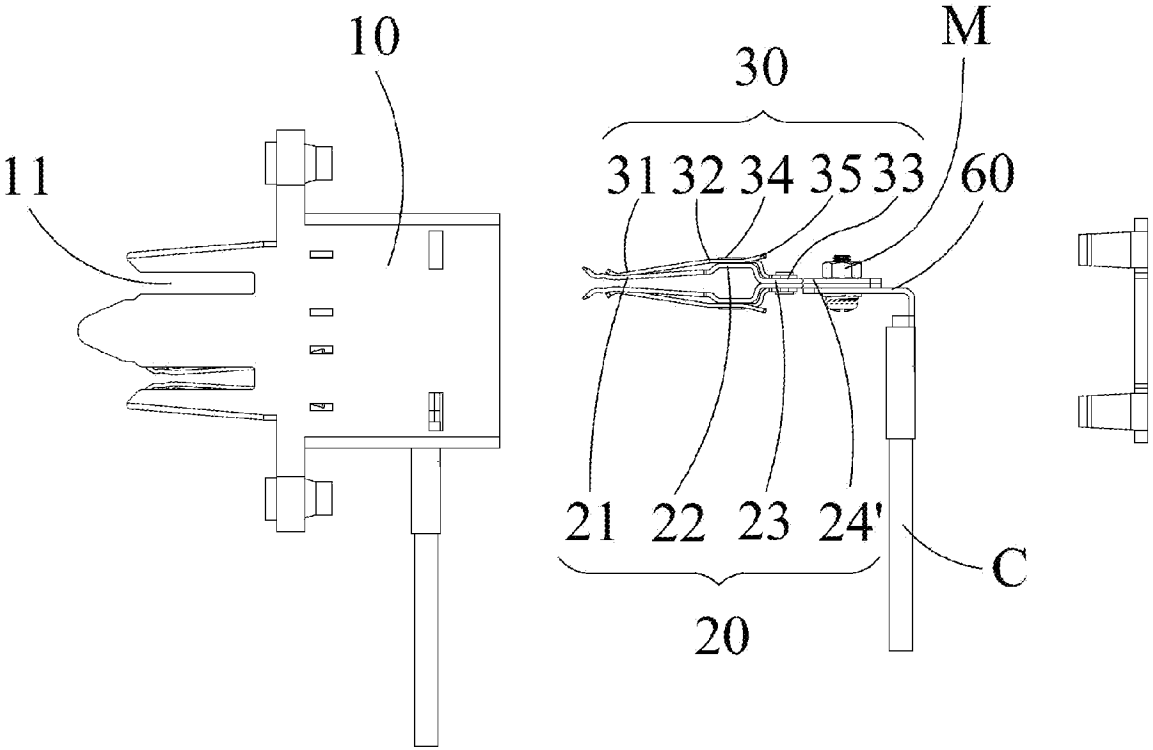
FIG. 6 is a side view of the electrical connector of FIG. 5.

FIG. 5 is an exploded perspective view of an electrical connector of the second embodiment of the present disclosure. FIG. 6 is a side view of the electrical connector of FIG. 5. The parts of this embodiment identical to the first embodiment are presented by the same symbols, and descriptions are omitted. The difference between this embodiment and the first embodiment is that the extension parts 24' of the first terminal member 20 of this embodiment are flattened and are overlapping each other. The electrical connector of this embodiment further comprises a cable connecting member 60, which is connected to the corresponding extension part 24' and the cable C. In this embodiment, the cable connecting member 60 is plate-shaped. A through hole is provided on the extension part 24' of the first terminal member 20 and the cable connecting member 60. The cable connecting member 60 is secured to the extension part 24' where the two first terminal members 20 overlap with a fastening part M. In this embodiment, the cable connecting member 60 could be made of different materials from the first terminal member 20 and the second terminal member 30. For example, the cable connecting member 60 could be made of soft brass, and the first terminal member 20 and the second terminal member 30 could be made of hard high-conductivity copper. In addition, the cable connecting member 60 can be connected to the cable C by soldering or ultrasonic welding.

In this embodiment, the cable connecting member 60 is bent-shaped. One end of the cable connecting member 60 is connected to the first terminal member 20. The other end of the cable connecting member 60 opposite to the first terminal member 20 is connected to the cable C. In this way, the extending direction of the first terminal member 20 intersects with the extending direction of the cable C. In this embodiment, the cable connecting member 60 is 90 degrees bent.

In summary, embodiments of the present disclosure provide an electrical connector, by disposing the first terminal members between the pair of second terminal members, the second elastic contacting parts of the second terminal members abut against the first elastic contacting parts of the first terminal members correspondingly. The second terminal members could apply a retaining force to the first terminal members to retain the first terminal members in contact with the circuit board. Each of the first elastic contacting parts is provided with a retaining force by individual second elastic contacting part. Thus, an average retaining force is provided to each of the first elastic contacting parts of each of the first terminal members. In addition, in the present disclosure, the pair of first terminal members is separable and the pair of second terminal members is also separable to facilitate the assembly and solves the problem of assembling difficulties in the prior art.

It is to be understood that the term "comprises", "comprising", or any other variants thereof, is intended to encompass a non-exclusive inclusion, such that a process, method, article, or device of a series of elements not only comprise those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

an insulating body comprising a mating groove;

a pair of first terminal members disposed in the mating groove, each of the first terminal members comprising a plurality of first elastic contacting parts;

a pair of second terminal members disposed in the mating groove, the pair of first terminal members disposed between the pair of second terminal members, each of the second terminal members comprising a plurality of second elastic contacting parts abutting against the plurality of first elastic contacting parts correspondingly; and a fastening part fastening the pair of first terminal members and the pair of second terminal members;

wherein each of the first terminal members further comprises a first abutting part; the plurality of first elastic contacting parts is connected to the first abutting part; each of the second terminal members further comprises a second abutting part; the plurality of second elastic contacting parts is connected to the second abutting part; the second abutting part abuts against the first abutting part;

each of the first terminal members further comprises a first connecting part; the first connecting part and the first elastic contacting part are respectively connected to two opposite ends of the first abutting part; each of the second terminal members further comprises a second connecting part; the second connecting part and the second elastic contacting part are respectively connected to two opposite sides of the second abutting part; the fastening part fastens the first connecting part and the second connecting part;

each of the first terminal members further comprises a cable connecting part connected to the first connecting part; a cable is connected to the cable connecting parts of the pair of first terminal members; and the electrical connector further comprises an annular securing member pressing the cable connecting parts.

2. The electrical connector according to claim 1, the fastening part comprises at least one fastener passing through the first connecting part and the second connecting part.

3. The electrical connector according to claim 1, wherein the cable is clamped between the cable connecting parts of the pair of first terminal members.

4. The electrical connector according to claim 1 further comprising a cable connecting member; the first terminal member further comprises an extension part connected to the first connecting part the cable connecting member is connected to the corresponding extension part and a cable.

5. The electrical connector according to claim 4, wherein the cable connecting member is bent-shaped; the extending direction of the pair of first terminal members intersects the extending direction of the cable.

6. The electrical connector according to claim 1, wherein each of the second terminal members comprises at least one rib; the at least one rib is disposed on the second abutting part and protrudes toward the insulating body; the at least one rib abuts against a groove wall of the mating groove.

7. The electrical connector according to claim 1, wherein each of the second terminal members comprises at least one elastic tab; the at least one elastic tab is disposed on the second abutting part and extends toward the insulating body comprising at least one buckling groove; the at least one elastic tab is buckled to the at least one buckling groove.

8. The electrical connector according to claim 1, wherein each of the first contacting parts is bent into a mesa shape; the first abutting parts of the pair of first terminal members are oppositely disposed.

9. The electrical connector according to claim 1, wherein the insulating body further comprises a stopping block supporting the pair of first terminal members; the stopping block tapers in a direction away from the mating groove; two sides of the stopping block respectively comprise inclined sidewalls adjacent to each of the groove walls.

10. The electrical connector according to claim 1, the pair of first terminal members is separable; the pair of second terminal members is separable.

11. The electrical connector according to claim 1, wherein the insulating body further comprises an anti-misconnecting part asymmetrically disposed compared with a shape of the mating groove.

12. The electrical connector according to claim 11, wherein the anti-misconnecting part comprises a bump disposed on an outer surface of the insulating body.

13. The electrical connector according to claim 1, wherein the insulating body further comprises a cable accommodating groove communicating with the mating groove.

* * * * *